United States Patent [19]

Cutler

[11] Patent Number: 4,534,674

[45] Date of Patent: Aug. 13, 1985

[54] DUAL-LIFT REPAVING MACHINE

[75] Inventor: Earl F. Cutler, Lawrence, Kans.

[73] Assignee: Cutler Repaving, Inc., Lawrence, Kans.

[21] Appl. No.: 486,726

[22] Filed: Apr. 20, 1983

[51] Int. Cl.[3] ..... E01C 23/00

[52] U.S. Cl. ..... 404/75; 404/82; 404/84; 404/90; 404/95; 404/101; 404/108

[58] Field of Search ..... 404/84, 90–92, 404/95, 75, 77, 79, 82, 101, 108, 111; 239/223, 224, 76; 134/172, 198; 222/618, 622, 623; 198/669, 661

[56] References Cited

U.S. PATENT DOCUMENTS

| | | | |
|---|---|---|---|
| Re. 25,275 | 10/1962 | Pollitz | 404/84 |
| 2,053,709 | 9/1936 | Flynn | 404/75 |
| 2,068,702 | 1/1937 | Poulson | 404/82 |
| 2,394,017 | 2/1946 | Seaman | 404/95 |
| 2,706,520 | 4/1955 | Chandler | 239/76 |
| 2,906,438 | 9/1959 | Carpenter | 222/618 |
| 3,199,786 | 8/1965 | Waldrum | 239/223 |
| 3,361,042 | 1/1968 | Cutler . | |
| 3,678,817 | 7/1972 | Martenson et al. | 404/84 |
| 3,724,445 | 4/1973 | Cutler . | |
| 3,732,023 | 5/1973 | Rank et al. | 404/90 |
| 3,807,886 | 4/1974 | Cutler . | |
| 3,874,366 | 4/1975 | Cutler . | |
| 4,008,975 | 2/1977 | Cutler . | |
| 4,011,023 | 3/1977 | Cutler . | |
| 4,012,160 | 3/1977 | Parker | 404/84 |
| 4,073,592 | 2/1978 | Godberson et al. | 404/89 |
| 4,124,325 | 11/1978 | Cutler . | |
| 4,172,679 | 10/1979 | Wirtgen | 404/90 |
| 4,226,552 | 10/1980 | Moench | 404/92 |
| 4,335,975 | 6/1982 | Schoelkopf | 404/77 |
| 4,453,856 | 6/1984 | Chiostri et al. | 404/91 |

*Primary Examiner*—Stephen J. Novosad
*Assistant Examiner*—Hoang C. Dang
*Attorney, Agent, or Firm*—Trexler, Bushnell & Wolters, Ltd.

[57] ABSTRACT

A road resurfacing or repaving machine is disclosed. The machine is self-propelled, and has a chassis. A preliminary heater depends from the machine chassis to provide preliminary heat to the underlying road. A preliminary scarifier breaks up the top of the heated road surface. A main heater behind the preliminary scarifier provides a second heating action, and a main scarifier behind the main heater further scarifies the hot road material and the road surface. Spray means sprays liquid asphalt cutback over the hot, scarified material. A first macadam dispensing device behind the spray means dispenses new hot mix material to the hot, sprayed material and road surface to make up solid material lost through pot hole formation or other road deterioration. A first mixer commingles the newly added hot mix with the old, sprayed, scarified material on the road surface. A first screed levels and at least partly compacts this material to form a first lift. Behind the first screed, a second dispensing device deposits additional, entirely new hot mix on the road surface. A second mixing device mixes this additional hot mix material in situ. Finally, a second screed levels and compacts this new hot mix to provide a second road lift.

22 Claims, 13 Drawing Figures

11
25
27
28a
28b
271
272
273
275
276
277
18,19
20
221, 222
26b
103
34
30
31
32
40
41
42
43
60
P
SP

DUAL-LIFT REPAVING MACHINE

BACKGROUND OF THE INVENTION

This invention relates generally to equipment for resurfacing highways and streets, and more particularly concerns equipment for providing, in a single pass, resurfaced roadway which will stand up to traffic wear and tear for a long time.

Macadam highways and streets have been built extensively in recent years. In general, these highways are laid over a base which can include a gravel or similar substructure, and in some instances they include an upper course of concrete. In its upper strata, the highway includes a macadam top surface formed of stone or gravel aggregate bound firmly together by a bituminous bonding agent such as asphalt. This asphalt bonding agent comprises a number of petroleum chemicals which have various melting, pour, and evaporative characteristics.

Such roads provide a relatively trouble-free permanent surface. Inevitably, however, the passage of time and traffic and the impingement of weather causes the macadam surface to become brittle and crack. Where concentrated cracking occurs, pieces of pavement may become dislodged. This dislodgement can create traffic hazards, and it accelerates the deterioration of adjacent pavement and highway substructure. Even if cracking and the loss of pavement pieces do not occur, the passage of traffic can polish the upper highway surface, and a polished, slippery highway surface may be dangerous. In addition, traffic-caused wear can groove or trough a highway surface. Under wet highway conditions, water can collect in these troughs and set up dangerous vehicle hydroplaning phenomena.

The repair of macadam roadways has thus become an important activity in recent years. To motorists, this repair work is essential for easy, care-free driving. To governmental departments and others in charge of street and highway repair, this activity can constitute a major portion of a budget. To repair contractors, such work can be profitable if it is done rapidly, effectively, and at low cost. But repairing these deteriorated highways and streets can be an expensive and difficult task if the repair contractor believes it necessary to remove macadam material, transport that material to a centralized, stationary, recycling plant, and bring new and recycled material back to the road site.

Use of such stationary macadam plants can be avoided, however. Equipment for repairing and resurfacing macadam highways and streets in situ has met with considerable commercial success. Equipment of this sort is described and claimed, for example, in Cutler U.S. Pat. Nos. 3,361,042; 3,724,445; 3,807,886; 3,874,366; 4,008,975; 4,011,023; and 4,124,325. In general, this equipment takes the form of a mobile chassis which carries various heating, scarfiying, mixing, and material handling systems. An engine, a fuel system and electrical and hydraulic devices operate these main systems. The machine or vehicle can be on the order of fifteen feet wide and sixty feet long; it is intended to move along a roadway with some dozen attendant workers at a rate of speed on the order of ten to thirty-five feet per minute. As the machine operates, the old road surface is excavated and combined with additional material, both solid and liquid, to form a new road surface during a single continuous machine pass. During the single continuous pass, the old road surface in front of the machine is excavated and converted into a refinished, smooth, new road surface at the rear of the machine. Solid materials are added to excavated and mixed recycled material to compensate for solids which have been lost as a result of pot holes in the road. Liquid material is added to replace asphalt binder material which has evaporated or which has been lost through water washing or other action.

Observations of macadam pavement, both new and recycled, indicates that extra structural strength and advantage can be obtained when two pavement lifts are provided. The first lift constitutes recycled material laid over an existing substructure or hot mix pavement surface, and a second lift, constituting entirely new hot mix, is laid over the first, recycled lift. Apparently the lower first lift acts as a relatively soft layer that relieves stresses otherwise applied to the new top surface layer. By providing these two layers, the rate at which existing cracks in the old subsurface reflect through pavement is much reduced.

It is accordingly the general object of the present invention to offer repaving equipment which will provide two pavement lifts in a single pass. More specifically, it is an object of the present invention to provide repaving equipment which will provide a bottom lift of recycled, rejuvenated material over existing roadway substructure, and a top lift of entirely new material.

It is another object of the invention to provide recycling equipment which will accommodate variations in necessary thickness of the lifts at one side of the repaving machine operation independently of the thickness requirements found at the other side of the repaving operation.

Yet another object is to offer repaving equipment having sensors and automatic controls for adjusting the amount of repaving material delivered to the road site.

Still another object is to provide a repaving machine which can be disassembled for easier shipment to distant job sites, and which can be easily and quickly assembled into a ready-to-operate repaving machine.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment and procedure, it will be understood that it is not intended to limit the invention to this embodiment and procedure. On the contrary, it is intended to cover all alternatives, modifications and equivalents as may be included within the spirit and scope of the invention as defined by the appended claims.

Figure 1:
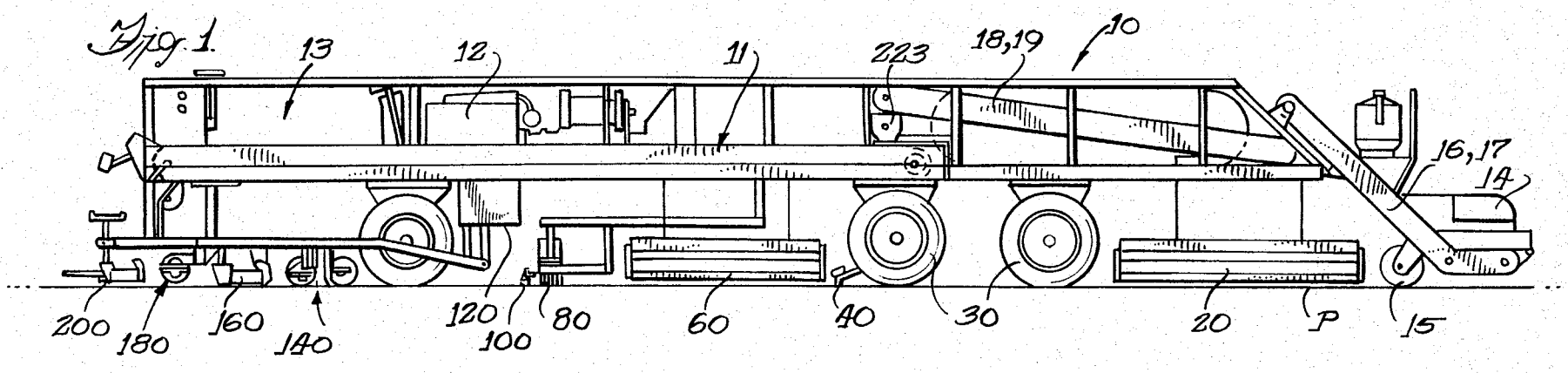
FIG. 1 is a side view in elevation showing an assembled mobile repaving machine embodying the present invention.
Figure 2:
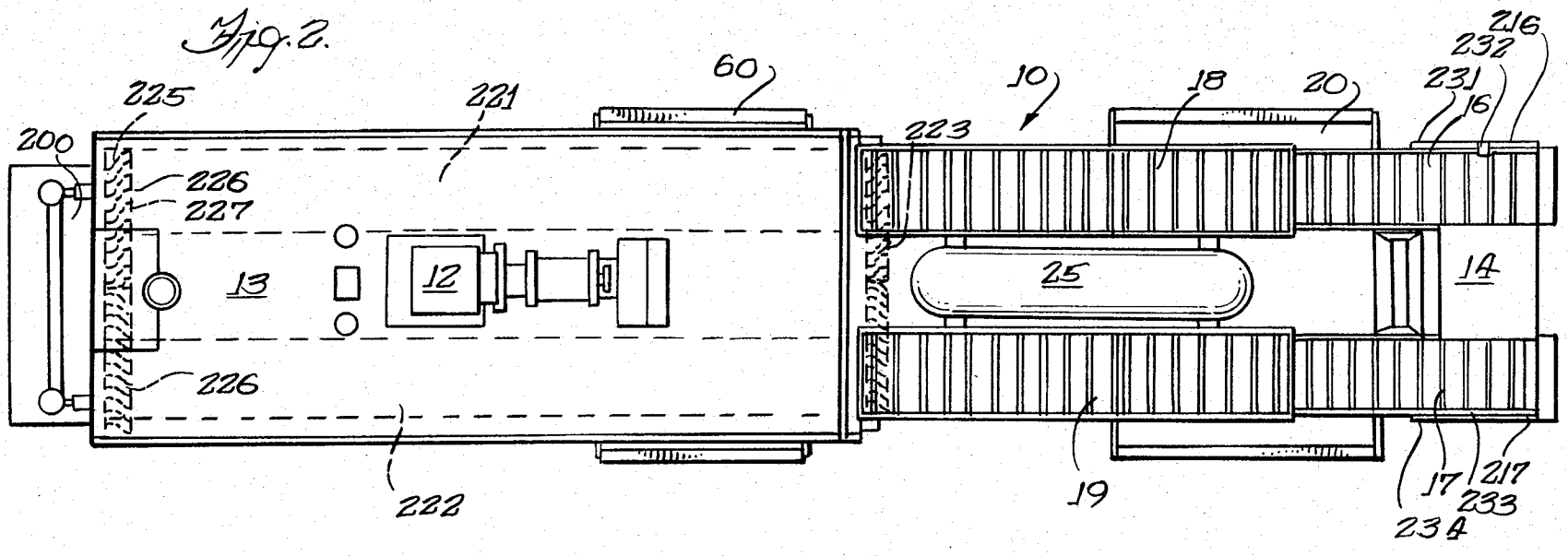
FIG. 2 is a top plan view of the novel repaving machine shown in FIG. 1.

Turning first to FIGS. 1-3, there is shown a road resurfacing machine 10 embodying the present invention. In accordance with the invention, this machine 10 is arranged to provide two relatively separate and independent lifts of pavement. In general, this vehicle 10 includes a chassis 11, a prime mover or engine 12, and a driver or operator's station 13.

As shown especially in FIG. 1, near the front of the machine 10 is a preliminary heater 20. Behind the heater 20 is a preliminary scarifier unit 40, and behind that preliminary scarifier 40 is a main heater 60, followed by a main scarifier 80. A spray unit 100 is located closely behind the main scarifier 80, and a first macadam hot mix dispensing device 120 is located just to the rear of the spray unit 100. Behind the dispenser 120 is a first mixing and leveling arrangement 140, and behind the mixer-leveler 140 is a first screed unit 160. A second macadam or hot mix dispensing arrangement 180 is located rearwardly of the first screed 160, and a second or final screed device 200 is located at the back of the machine 10 behind the second mixing mechanism 180.

Figures 3A, 10:
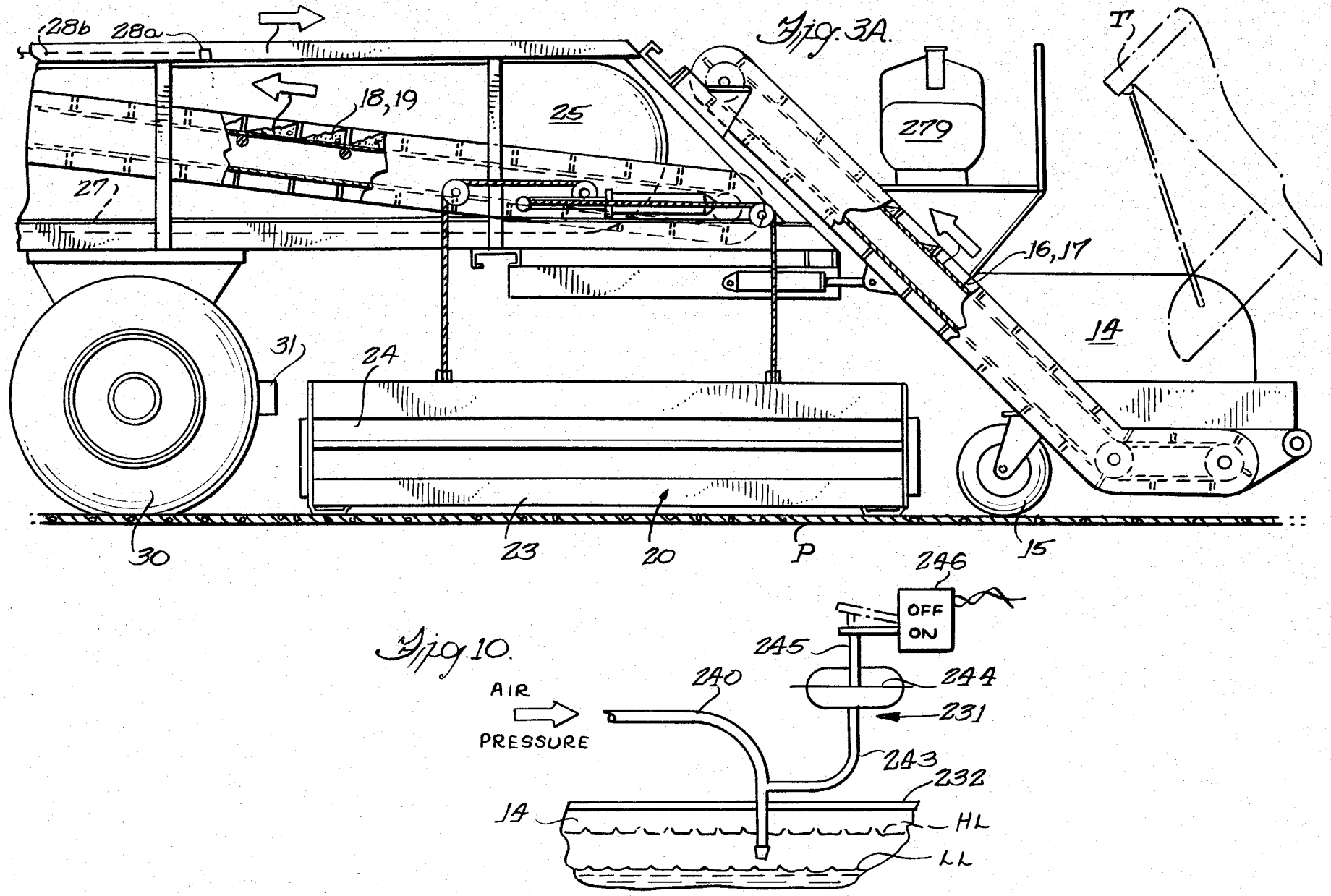
FIG. 3A is a side elevational view showing in further detail the front portion of the repaving machine shown in FIGS. 1 and 2.
FIG. 10 is a partially schematic diagram showing a hot mix receiving hopper and an associated sensor and control circuitry.

More particularly, a receiving hopper 14 is located in front of the main chassis 11, and it can be supported upon its own carriage wheels 15. As shown especially in FIG. 2, two independently driven elevating conveyors 16 and 17 convey materials from the left and right sides of the receiving hopper 14 upwardly and rearwardly. Here, the material is dropped onto first transfer conveyors 18, 19. New hot mix asphalt material can be dumped into the receiving hopper 14 from any convenient supply such as a dump truck T (FIG. 3A).

As the machine moves in a direction of travel shown by the arrows Tr in FIGS. 1 and 3, the underlying roadway surface pavement P is first subjected to heating by a heater unit 20.

The pavement P must be heated thoroughly, so as to soften or melt the asphaltic binder, and so as to heat the gravel or other solid aggregate. To do this, the heater unit 20 has a chamber 23 adapted to closely overlie the area of the pavement P to be heated. The heater 20 is provided with burners 24 which are fueled from a propane fuel tank or other suitable fuel source 25 mounted atop the chassis 11. The heater can be of the type shown and described in U.S. Pat. Nos. 3,724,445; 3,801,212; 3,807,886; or 3,865,098, or it can be of some other suitable, known type.

Suitable pressure must be maintained in the propane tank 25 in order that the propane fuel be properly delivered to the heaters 20 and 60. This pressure can be created by slightly warming the tank 25. To accomplish this warming, it is a feature of the invention that the engine 12 has an exhaust system 26 connected by a three-way valve 26*a* and suitable piping 26*b* to warming pads 27 under the tank 25 (see FIGS. 3C and 3A). An electrical control system 28 includes pressure sensors 28*a* connected by wiring 28*b* to the three-way valve 26*a*. When the pressure in the propane tank 25 falls below a pre-set minimum of, say, 50 psig, the control system 28 operates to direct hot engine exhaust gases to the tank warmers 27. When the tank 25 is warmed, thereby encouraging the gasification of the propane inside, pressure rises inside the tank. When pressure rises above the pre-set minimum, the control system 28 operates to re-configure the three-way valve 26*a*, and direct the hot engine exhaust gases up a stack 29, away from the propane tank 25 and tank warmers 27.

It is known that black asphalt cement will absorb radiant heat almost three times as fast as the solid gravel aggregates used in the macadam mix. Thus, to obtain a uniform, elevated temperature in the pavement P, it has been found helpful to permit the heat applied by the preliminary heater 20 to soak into the pavement before scarifying occurs. For this reason, the scarifier unit 40 is spaced at some distance behind the preliminary heater unit 20. To provide this arrangement and permit this soaking efficiently and conveniently, the front wheels 30 are located between the preliminary heater means 20 and the preliminary scarifier unit 40, as especially shown in FIG. 3B. The front wheel arrangement 30 can be provided with four rubber tires, as can be envisioned from FIGS. 1 and 3B, and can be of the all-wheel-drive variety. Hydraulic motors 31 and 32 can be provided from an appropriate hydrostatic drive 33 located above the chassis (see FIG. 3C) to provide a motive power to the wheels. An appropriate supply of hydraulic fluid 34 can be carried by the chassis at some convenient location (see FIG. 3B).

Behind the front wheel unit 30 is the preliminary scarifier 40. This scarifier 40 can be of the type disclosed and claimed in U.S. Pat. No. 3,907,450. In general, the scarifier unit 40 includes blades 41 mounted upon a pivoted arm 42 and arranged to engage the pavement P so as to excavate or dig up the road surface and provide broken, gravel-like pavement aggregate pieces. Downward, pavement-engaging pressure is applied to these blades 40 by means of air bags 43.

Figures 3B, 4:
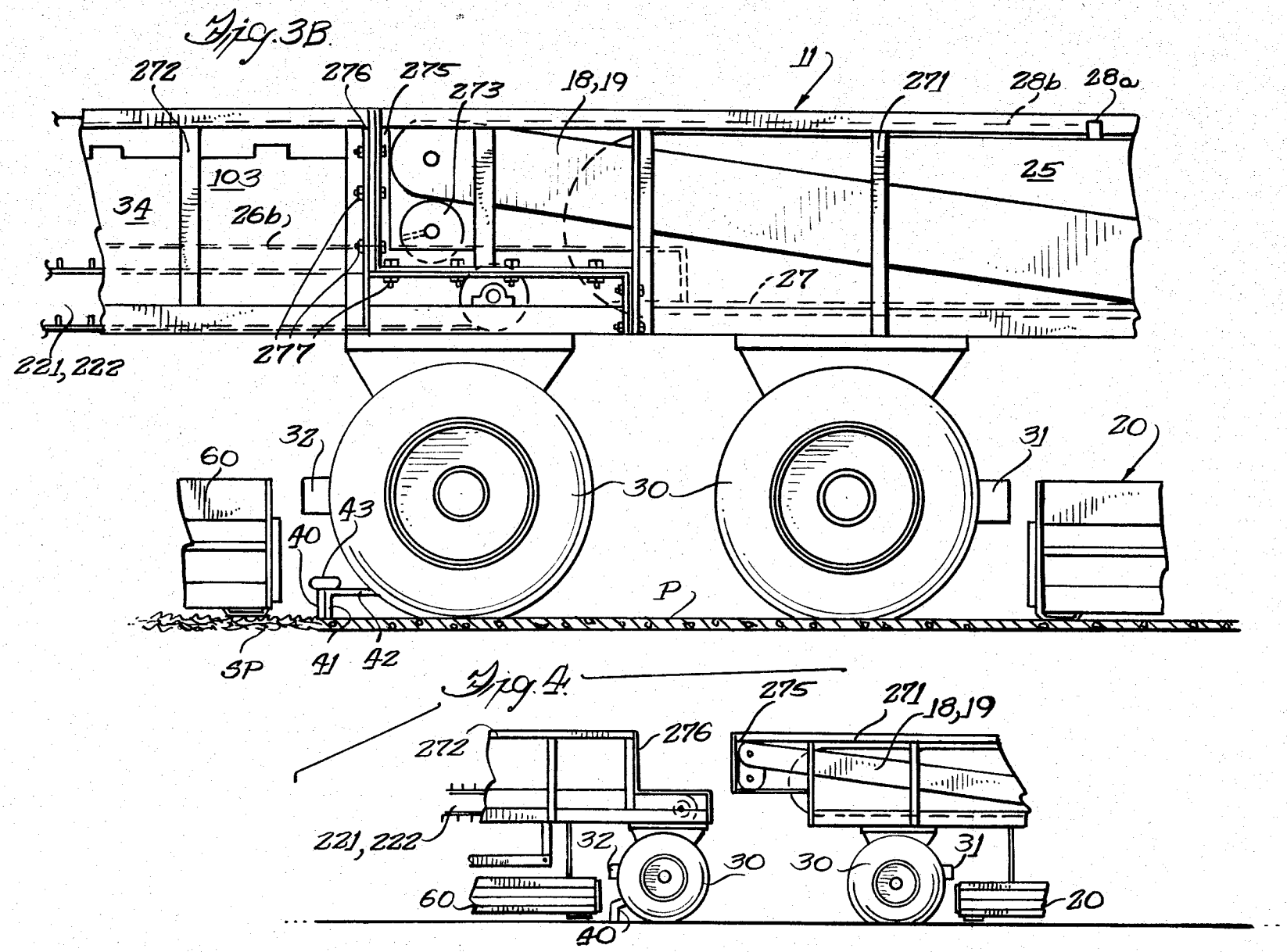
FIG. 3B is a side elevational view showing in further detail the middle portion of the repaving machine shown in FIGS. 1 and 2.
FIG. 4 is a fragmentary side elevational view showing in further detail the arrangement for disassembling and reassembling the machine.

To permit more complete roadway excavation, pavement breakup and scarifying action, a main heater unit 60 is provided behind the preliminary scarifier unit 40, as shown in FIGS. 1 and 3B. This main heater unit 60 can be constructed and fashioned in a manner like that of the preliminary heater unit 20 described above, and provides additional heating action to the broken aggregate particles, and to the scarified road surface or scarified pavement SP as indicated in FIG. 3B.

Figures 3C, 7:
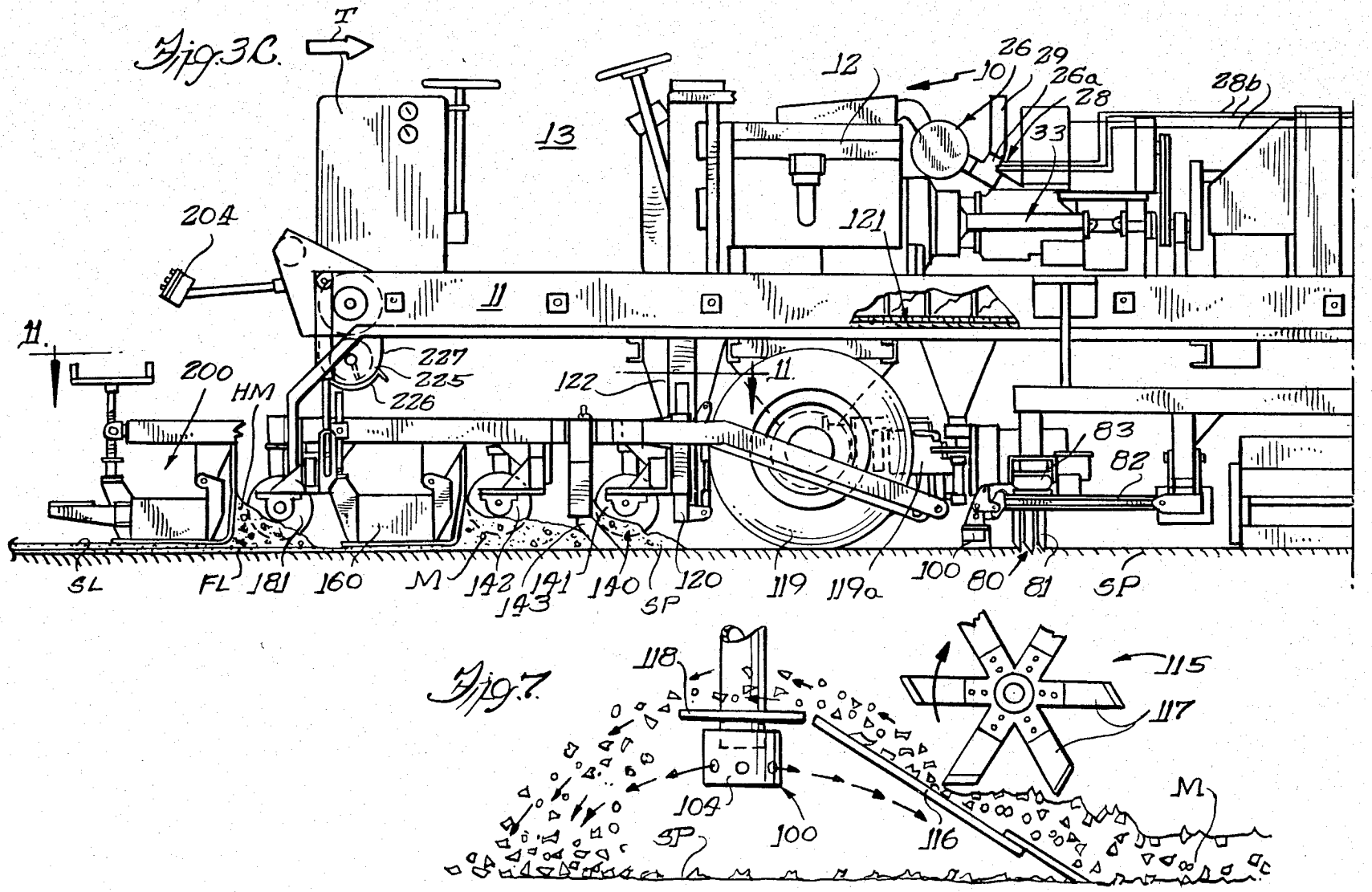
FIG. 3C is a side elevational view showing in further detail the rear portion of the repaving machine shown in FIGS. 1 and 2.
FIG. 7 is a side elevational view showing, in somewhat schematic form, an alternative or optional ramp and rotor mechanism associated with the cutback spray units shown in FIGS. 5 and 6.

Behind the main heater unit 60 is the main scarifier unit 80, as shown in FIG. 3C. This unit 80 can be constructed like the preliminary scarifier unit 40: a series of scarifier blades 81 depend from one or more hinged arms 82, and the blades are forced into engagement with the scarified pavement SP by an air bag arrangement 83.

Figure 5:
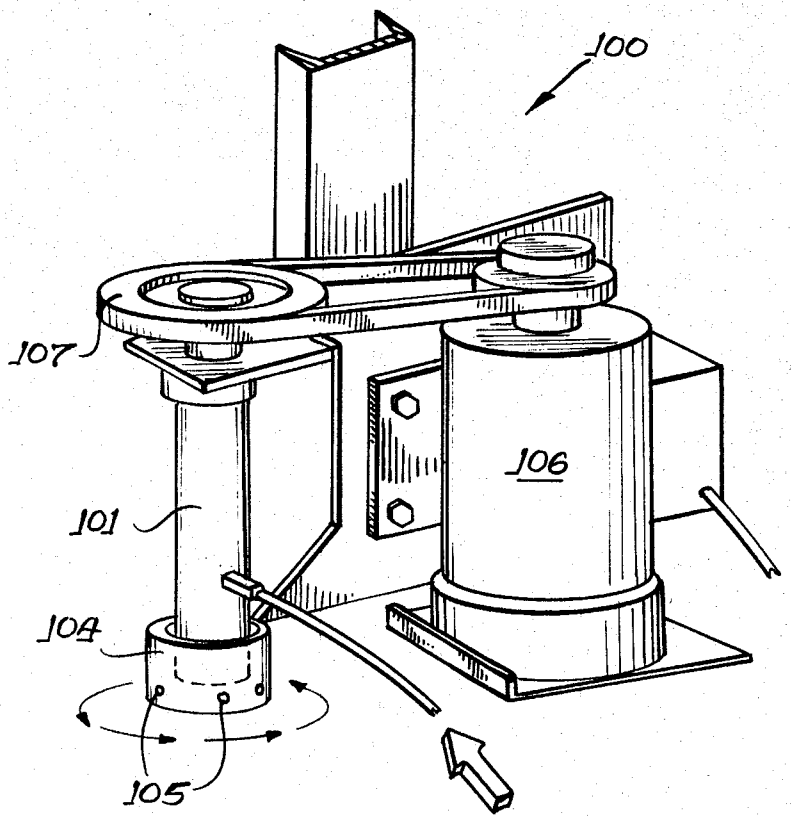
FIG. 5 is a perspective view showing in further detail one of the cutback spray units shown in FIG. 3C.

Immediately behind the scarifier unit 80 is an asphalt cutback liquid dispensing or slinger unit 100, shown in further detail in FIG. 5. It is the function of this liquid dispensing unit 100 to dispense an asphalt cutback liquid which replaces the lighter, more volatile hydrocarbons which have evaporated or which have been washed out of the pavement during pavement use. In general, the unit 100 includes a downpipe 101, which is provided with a supply of liquid asphalt cutback material through an appropriate piping arrangement 102 from a supply tank 103 mounted above the chassis 11 (FIG. 3B). Rejuvenated liquid flowing into and down the downpipe 101 is dispensed from a rotating cup 104, in which has been formed a series of dispensing orifices 105. This cup 104 is rotated, at a relatively rapid rate, by a drive motor 106 and an appropriate drive mechanism 107. In this way, a whirling or circular pattern liquid dispensing action is achieved. A relatively even coating of liquid rejuvenator material is thus spread on the scarified, loosened aggregate and the underlying pavement.

Figure 6:
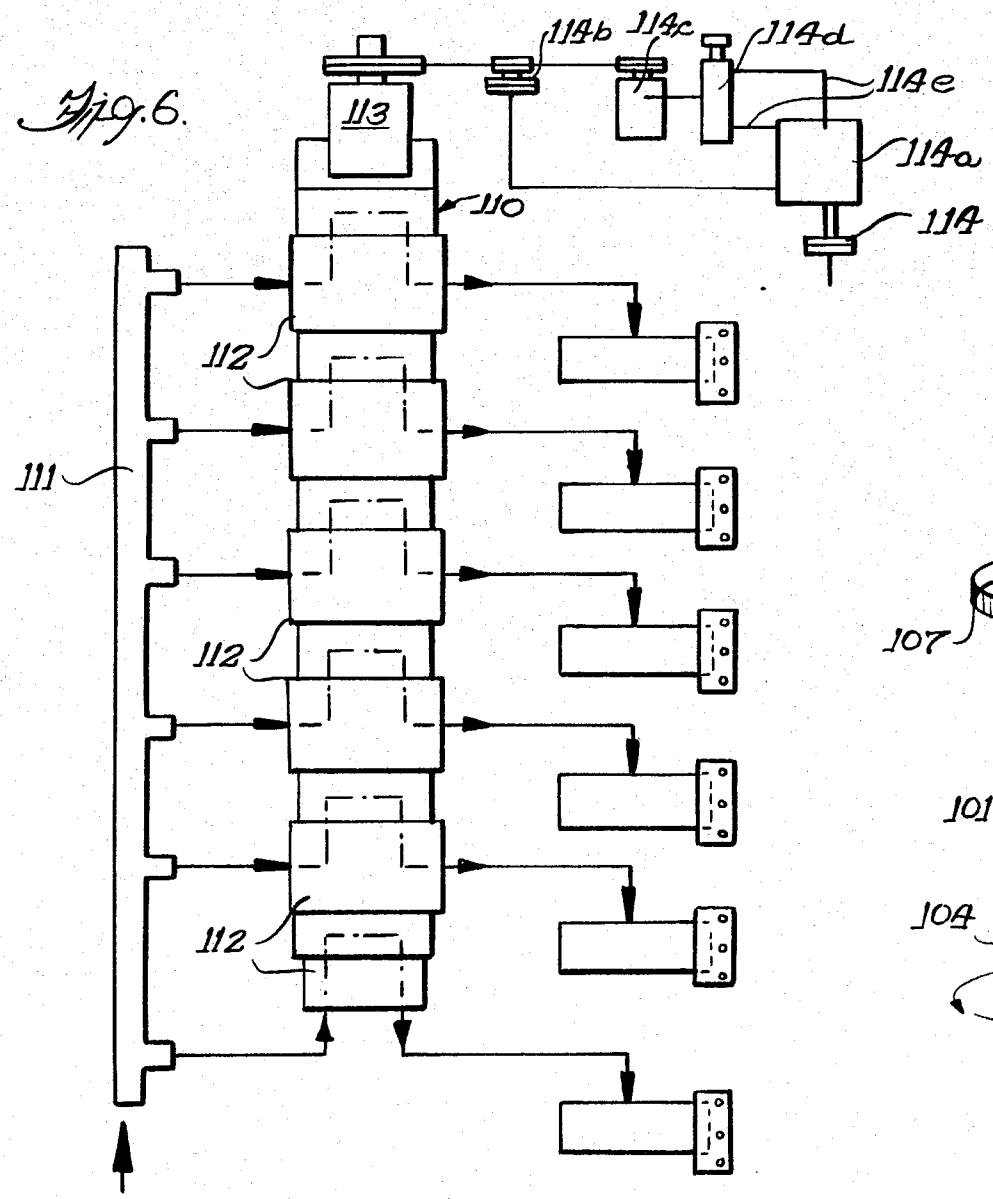
FIG. 6 is a schematic view showing the piping and pumping arrangement for several of the spray units shown in FIG. 5.

To provide even, complete cutback dispensation across the entire width of machine travel, a series of these liquid dispenser units 100 is arrayed in a transverse row across the machine, as can be envisioned from FIGS. 1, 3C, and 6. An even flow of rejuvenator liquid to each of the units 100 is provided by a six-section metering pump 110, as indicated in FIG. 6. A manifold 111 distributes liquid rejuvenator cutback from the storage tank 103, and each pump unit 112 is driven, through a drive device 113, at a speed which is identical to the speed of all the other pump units 112. In this way, identical amounts of rejuvenator fluid are dispensed at identical pressures to each of the slinger units 100.

If desired, a ground speed sensor 114 can be connected to the pump drive 113 so as to insure that the amount of liquid cutback dispensed is directly proportional to the rate of speed of the unit, and to the ground and broken aggregate being traversed. Here, a commercially available speed sensor 114 is connected to a controller unit 114*a*. The controller can be a Dickey-john controller, Part Number 10739-0090, chart number 11007-0075, available from the Dickey-john Corporation of Auburn, Ill. A second speed sensor 114*b* is functionally interposed between the pump drive unit 113 and a hydraulic motor 114*c*. The controller 114*a* senses the ground speed through the first sensor 114, and senses the pump speed (and corresponding pump output), and sends regulatory signals to a hydraulic drive motor speed control valve 114*d* through wires 114*e*. In this way, pump speed and output is kept proportional to the speed of the vehicle 10.

It will be understood that considerable pavement is heated and scarified by this machine; scarification of up to a depth of two to two and one-half inches is contemplated. It will also be understood that complete cutback coating of the scarified rubble and of the underlying pavement surface is beneficial. To encourage this complete coating action, the ramp and rotor mechanism 115 shown in FIG. 7 can be associated with the slinger dispensing system 100, if operating conditions make it desirable to do so. The mechanism 115 includes a pick-up ramp 116 which collects the rubble or scarified material M, and an undershot rotor 117 whips the material M over and past the slinger cups 104. In this way, the material M is more or less airborne when struck by the slung cutback liquid, and complete coating of each particle is encouraged. Moreover, the scarified pavement SP is relatively free of material M when the cutback liquid is slung over it, and so relatively complete coating of the pavement surface is also encouraged. A plate 118 can be installed over the slinger cup 104 to prevent airborne material M from falling into the cup and fouling it. The rotor 117 can be driven by a hydraulic motor or other convenient means.

The rear wheel system 119 is located immediately behind the liquid slinger or dispenser system 100 (and behind the ramp and rotor mechanism, if that is installed). Like the front wheel system 30, this rear wheel system 119 can be of the all-wheel-drive variety, and can be powered by a suitable hydraulic motor 119*a*.

Figures 8, 9:
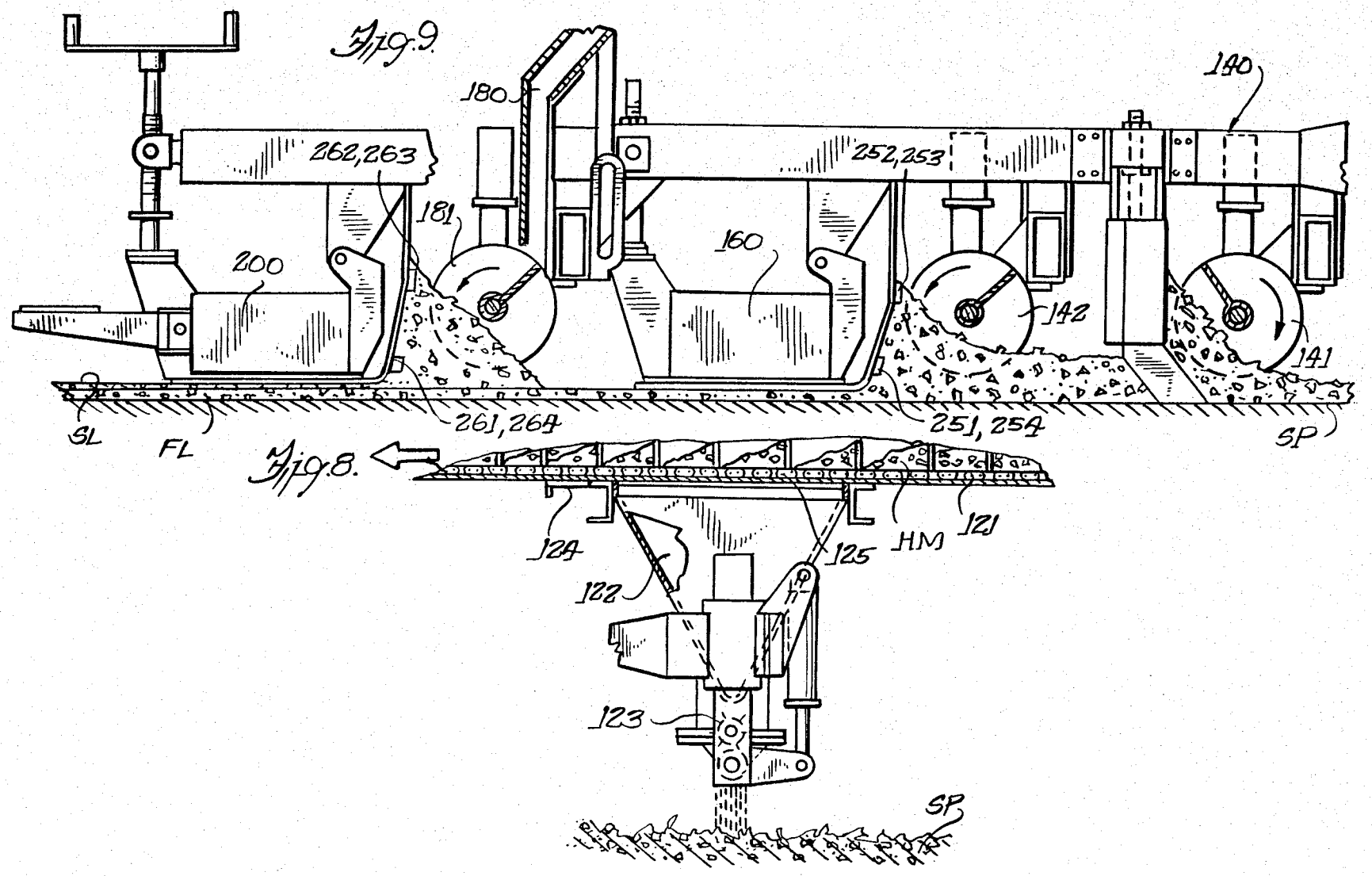
FIG. 8 is a fragmentary side elevational view showing the first hot mix dispensing unit shown in FIG. 3C.
FIG. 9 is a fragmentary side elevational view showing in further detail the mixing, leveling, and compacting equipment shown at the rear of the machine in FIG. 3C.

Immediately behind the rear wheel unit 119 is the hot mix dispenser system 120. This apparatus receives hot mix from the transfer conveyor system 121. As shown in FIG. 8, hot mix HM falls through openings in the conveyor system floor and into collector bins 122. Vaned, aggressive stripper rollers 123 aggressively draw hot mix from the collector bins 122 and dispense it upon the scarified, cutback-coated pavement surface SP. The stripper rollers can be driven by hydraulic motors or other suitable devices. If desired, sliding bin doors 124 can be provided to adjust the size of the openings 125 leading to the bins 122, and to consequently adjust the maximum rates of which hot mix material can be dispensed to the pavement SP. It will be understood that the bins 122 and doors 124 operate independently on the left and right side of the machine; the amount of material dispensed on the left and right side of the repaving area thus can be independently adjusted.

Figure 11:
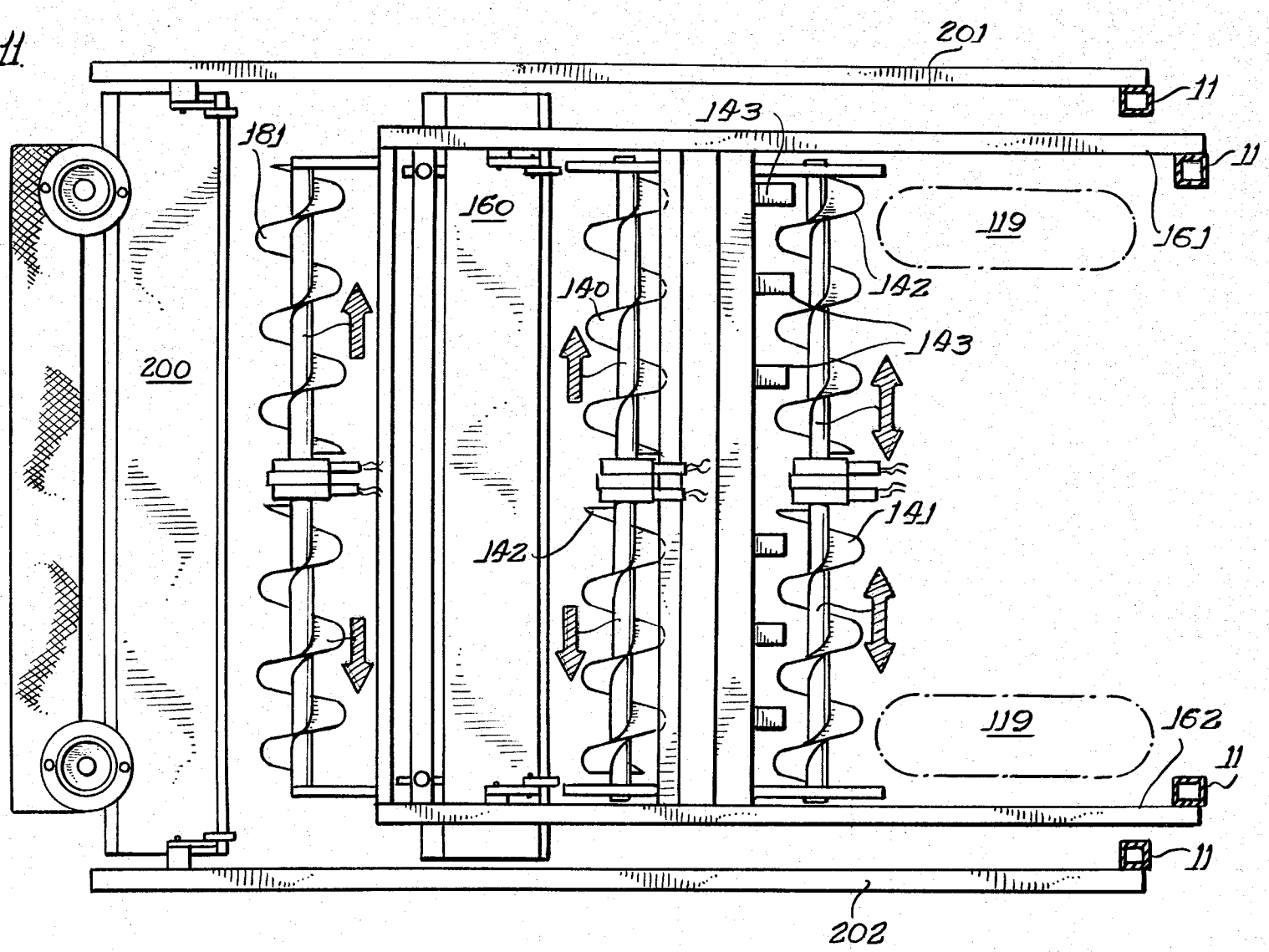
FIG. 11 is a fragmentary plan view taken substantially in the plane of line 11—11 in FIG. 3C and showing the leveling screeds and associated mounting and towing or pulling mechanisms.

Directly aft of the dispensing unit 120 is a first mixing arrangement or system 140, as shown in FIGS. 3C, 9 and 11. Here, this mixing system 140 takes the form of augers 141, 142 which are driven by a suitable hydraulic system (not shown) powered by the vehicle engine 12. These augers 141 and 142 commingle the old, sprayed material and new hot mix, and spread the commingled mix transversely across the scarified pavement SP. Further mixing and commingling is provided by a series of mixing blades 143 mounted immediately behind the first auger arrangement 141.

A first screed 160 is pulled by the chassis 11 behind the mixing system 140 to level and preliminarily compact the commingled hot mixed material M. It will be understood that this material M includes both the hot mix HM delivered by the dispensing unit 120 and the old aggregate material which has been heated and scarified from the pavement P and treated with the cutback by the slinger or liquid dispensing units 100. This screed unit 160 can be of the type described in U.S. Pat. No. 4,124,325. In this way, a first level or lift FL is formed. As shown particularly in FIGS. 3, 6 and 11, arms 161, 162 are journaled to the chassis 11, and are connected to the first screed unit 160. This arrangement permits the screed unit 160 to rise and fall independently of the vehicle 10, and to provide an accurately compacted and profiled first lift.

Immediately behind the first screed 160, another hot mix dispensing arrangement 180 is found. If desired, this dispenser system 180 can be constructed like the first dispenser system 120. Here, remaining portions of the hot mix are received from the transfer conveyor system 121 and are dispensed atop the first lift FL. The deposited hot mix material is mixed and commingled in situ by an auger unit 181. This auger unit 181 can be driven by a hydraulic system similar to that provided for the mixing and leveling unit 140 in other portions of the machine.

At the rear of the machine is a second screed unit 200. This screed unit 200 can also be devised in accordance with U.S. Pat. No. 4,124,325, or some other convenient screed arrangement can be used. The screed unit 200 levels and at least preliminarily compacts the hot mix HM delivered by the rinal hot mix dispensing unit 180 so as to provide a second lift SL above the first lift FL. To permit the screed unit 200 to rise and fall independently of the vehicle 10, arms 201, 202 are journaled to the chassis 11 and are connected to the screed 200 (FIG. 11). Again, this arrangement permits the second screed unit 200 to accurately compact and profile the second lift SL.

A screed operator's panel 204 extends behind the machine. This panel controls the screeds 160 and 201 so as to provide the desired compacting and profiling action.

Thus, it will be understood that the second lift is comprised of almost entirely new hot mix, while the first lift is comprised of both new and old aggregate and asphalt binder. In accordance with the invention, the first lift FL provides a relatively resilient material which acts as a stress-relieving layer. This stress-relieving layer reduces the rate at which existing cracks in the old surface will reflect through the new surface. The top layer SL provides a highly drivable surface.

As can be envisioned from the foregoing description, the present invention provides a highly useful long-life pavement at low cost. The pavement is provided quickly and in situ, and minimizes the amount of work area which must be closed to traffic. Moreover, recycled material is used as a stress-relieving leveling course FL, and all new material is placed in the surface of the road in a top course SL.

In accordance with another aspect of the invention, hot mix material deposited in the receiving hopper 14 is conveyed as pavement lift thickness requirements vary on either the right side of the machine 141 or the left side of the machine I42. This hot mix conveyance and delivery on one side occurs independently of hot mix demand or delivery on the opposite machine side.

To accomplish this, two independently driven conveyors 16 and 17 are provided at opposite sides 216 and 217 of the hopper 14, as explained above and as shown especially in FIG. 2. Each conveyor 16 and 17 leads to first transfer conveyors 18 and 19. These conveyors lead, in turn, to a right-side conveyor 221 and a left-side conveyor 222, which are driven independently of one another. The conveyors 221 and 222 independently carry hot mix to independently operable left- and right-side dispensing units which comprise the first dispensing system 120. Undispensed hot mix is carried back to the left- or right-side dispensing units comprising the final dispensing system 180.

It will be recognized that one side of the paving area may require more hot mix than the other side. For example, the right- or curb-side of the paving area may be more deteriorated than the left- or center-side. Under these circumstances, the right-side conveyor 222 may operate almost continuously, while the left conveyor 221 operates rarely. To prevent the quiescent hot mix on the right-side of the machine from cooling, a cross-transfer screw conveyor 223 is functionally interposed between the first transfer conveyors 18, 19 and the second or main transfer conveyors 221 and 222. This screw unit 223 can draw unused, cooling hot mix from one inactive side of the machine to the other, where it can more quickly be deposited on the moving conveyor 221 or 222 tor prompt deposition and emplacement.

In similar manner, a cross-screw transfer conveyor 225 is hung below the rear ends of the conveyors 221, 222 (FIG. 3C). Doors 226 below a conveyor trough 227 can be manually adjusted to regulate the amounts of hot mix dropped into the final hot mix dispensing unit 180 and into the second lift SL. When desired, one or more selected door 226 can be entirely closed; when corresponding doors 124 associated with the dispenser 120 are closed, the effective width of hot mix deposition is narrowed. This width-of-pavement adjustment feature permits the vehicle 10 to be used in repaving roads of less than standard, full-machine, width.

On-demand delivery of hot mix is provided. To this end, a sensor 231 is located on the left side 232 of the receiving hopper 14, and another, independent sensor 233 is located on the right side 234 of the hopper 14. Appropriate pneumatic, hydraulic electrical circuits are connected between the left sensor 231 and left elevating conveyor 16, and between the right sensor 233 and right elevating conveyor 17. Whenever the level of paving material in the surge bin falls below a predetermined level, the associated conveyor drive is activated to draw more hot mix from the receiving hopper 14 up the conveyor 16 or 17 to the conveyors 18 or 19. Appropriate sensors (not shown) activate the independent drives of the transfer conveyors when material levels fall below pre-selected amounts in either the first or second dispersing systems 120 or 180. Thus, if the machine encounters a large pot hole on the right or curb side, increased amounts of new hot mix material will be required as make-up in the right side of the first lift. If the pot hole does not extend entirely across the traffic lane, no make-up material will be required by the first delivery system on the left side. By providing individual right and left sensors, actuators, drives and conveyors, make-up material can be delivered to the right-hand delivery system without adjusting or disturbing material flow on the left-side of the machine.

A typical material level sensor 231 is shown in FIG. 10. In accordance with this aspect of the invention, the sensor 231 senses the presence or absence of hot mix at a given level, and accordingly adjusts a signal to the corresponding conveyor drive. To this end, the sensor 231 includes a small-diameter pipe 240 to which air is supplied from a remote source (not shown). This pipe extends through the side 232 of the receiver hopper at a pre-selected location. So long as the level of the hot mix is at a low level LL below a pipe nozzle 241, relatively low air pressure will be experienced in the pipe 240. When, however, the amount of hot mix rises to a high level HL, the nozzle 241 is blocked, and air pressure rises in the pipe 240 and in a branch line 243. Increased air pressure moves a diaphragm 244; diaphragm movement repositions a pin 245; the pin 245 operates an off-on switch 246 to alter a signal to the associated conveyor drive. When the amount of hot mix HM again falls to the low level LL, the air pressure flows out the nozzle 241, thus cleaning the nozzle, lowering the air pressure and repositioning the off-on switch 246.

Similar sensors 251, 252, 253, 254 and 261, 262, 263 and 264 can be installed adjacent the screeds 160 and 200, as shown in FIG. 9. As explained generally above, central right sensors 252 and 262 are connected by known circuitry (not shown) to the right transfer conveyor drive to operate the right conveyors 222 and 17 and deliver more hot mix when the amount of unscreeded hot mix falls below a predetermined level. Outboard right sensors 254 and 264 are similarly connected to the drives of the auger 141, 142 and 181 to halt auger spreading action if the amount of hot mix reaching the right outer side of the machine 10 exceeds a predetermined level. Central left sensors 253 and 263 likewise control the left conveyors 221 and 18; left outboard sensors 254 and 264 control the left augers. In this way, adequate hot mix is provided for both the first lift and second lift, and excessive hot mix is not dumped on the road to be wasted.

In accordance with another aspect of the invention, the repaving machine 10 can be easily and quickly taken apart into components, so as to facilitate machine shipment on railroad cars, flatbed trucks or the like. To this end, the chassis 11 includes a front assembly 271 and a rear assembly 272. These assemblies meet and mate at abutting flanges 275, 276. During machine operation, these flanges 275, 276 are rigidly joined by bolts 277 or other suitable fasteners. For transport, the frame assemblies 271 and 272 can be disconnected, as shown in FIG. 4. Hydraulic, electrical and other lines (not shown) crossing the frame flanges 275, 276 can be provided with quick-disconnect couplings. It will be noted that the conveyors 18, 19 mounted on the front frame assembly 271 are not directly connected to the conveyors 221, 222 mounted on the rear frame assembly 272. Thus, no expensive and difficult disconnection or disassembly of these conveyors need be undertaken when the machine is readied for transport. If desired, a separate engine 279 (FIGS. 1 and 3A) can be provided on the front frame assembly to provide motive and other power for the separated front portion of the machine.

The invention is claimed as follows:

1. A road resurfacing machine comprising, in combination, a chassis, preliminary heater means depending from the chassis and located adjacent the road surface; preliminary scarifier means depending from the chassis and spaced apart from the preliminary neater means for carifying a heated road surface; main heater means depending from the chassis and located adjacent the pavement behind the preliminary scarifier means for heating scarified road material; main scarifier means depending from the chassis and spaced apart from the primary heater means for further scarifying hot road material and the road surface; spray means depending from the chassis for spraying liquid asphalt over hot, scarified material; ramp means located behind the main scarifier means and in front of the spray means; rotor means associated with the ramp means for causing scarified road material to travel up the ramp and for whipping the traveling scarified material through the air past the spray means; first macadam dispensing means carried by the chassis and located behind the spray means for dispensing new hot mix material on the hot sprayed material and road surface; first mixing means located behind the first macadam dispensing means for commingling the the newly-added hot mix material with the hot, sprayed material on the road surface; first screed means connected to the chassis for leveling the hot, mixed material to form a first lift; second macacam dispensing means carried by the chassis and located behind the first screed means for dispensing additional new hot mix material atop the mixed, leveled material on the road surface; second mixing means carried by the chassis behind the second macadam dispensing means for spreading the additional new hot mix material over the first lift; and second screed means connected to the

2. A road resurfacing machine according to claim 1 including front wheel means movably supporting the chassis and located between the preliminary heater means and the preliminary scarifier means.

3. A road resurfacing machine comprising, in combination, a chassis, main heater means depending from the chassis and located adjacent the pavement for heating road material; main scarifier means depending from the chassis and spaced apart from the primary heater means for scarifying hot road material and the road surface; spray means depending from the chassis for spraying liquid asphalt over hot, scarified material on the road surface; first macadam dispensing means carried by the chassis and located behind the spray means for dispensing new hot mix material on the hot sprayed material and road surface; first mixing means located behind the first macadam dispensing means for commingling the newly-added hot mix material with the hot, sprayed material on the road surface; first screed means connected to the chassis for leveling the hot mixed material to form a first lift; second macadam dispensing means carried by the chassis and located behind the first screed means for dispensing additional new hot mix material atop the mixed, leveled material on the road surface; second mixing means carried by the chassis behind the second macadam dispensing means for spreading the additional new hot mix material over the first lift; and second screed means connected to the chassis for leveling and compacting the new hot mix material spread atop the first road lift so as to form a second road lift.

4. A road resurfacing machine according to claims 1 or 3 including rear wheel means movably supporting the chassis and located between the spray means and the first macadam dispensing means.

5. A road resurfacing machine according to claims 1 or 3 wherein said spray means includes a supply of liquid cutback fluid, a downpipe adapted to receive cutback fluid from the remote supply, slinger cup means mounted at the bottom of the downpipe for receiving fluid cutback from the downpipe and for slinging the fluid in a circular pattern, and slinger cup drive means for rotating the slinger cup.

6. A road resurfacing machine according to claim 5 wherein said slinger cup drive means includes drive shaft means carried for rotation within said downpipe means.

7. A road resurfacing machine according to claim 5 wherein said spray means includes a plurality of downpipes and a corresponding plurality of slinger cups mounted for rotation at the bottom of each of said downpipes, and a metering pump for providing identical amounts of cutback fluid at identical pressures to each of the slinger cups.

8. A road resurfacing machine according to claims 1 or 3 wherein said first macadam dispensing means comprises at least one holding bin, and at least one aggressive stripper roll carried at the holding bin bottom for aggressively stripping hot mix material from the holding bin and dispensing said hot mix material to the road below.

9. A road resurfacing machine according to claims 1 or 3 wherein said second macadam dispensing means comprises at least one holding bin for holding all undispensed hot mix material, and at least one aggressive stripper roll carried at the holding bin bottom for aggressively stripping hot mix material from the holding bin and dispersing said hot mix material to the road below.

10. A repaving machine according to claims 1 or 3 wherein said chassis includes front and rear chassis assemblies which can be disconnected from one another to ease repaving machine transport.

11. A repaving machine according to claim 3, further comprising, in combination, a receiving hopper for receiving paving material, paving material conveyor means for conveying material from the receiving hopper, and including conveyor drive means, sensor means associated with hot mix delivery means for sensing the level of material at the delivery means, and circuit means connected to the sensor means and the conveyor drive means, whereby the conveyor means is driven so as to transfer material from the receiving hopper to the delivery means whenever the level of paving material at the delivery means falls below a predetermined level.

12. A repaving machine according to claim 11 further including at least one sensor means located at each opposite side of said receiving hopper; wherein said conveyor means comprises at least two elevating conveyors, each conveyor being operable independently of the other; wherein a sensor at one side of the receiving hopper controls an elevating conveyor adjacent that side of the hopper; and wherein another sensor at the other side of the receiving hopper controls the other elevating conveyor independently of the first conveyor and first sensor.

13. A repaving machine according to claim 11 further comprising at least one hot mix delivery means, and wherein said conveyor means includes at least one transfer conveyor means for transferring hot mix from elevating conveyors to the delivery means.

14. A repaving machine according to claim 13 wherein said transfer conveyor means comprise left and right transfer conveyors, each conveyor being operable independently of the other.

15. A repaving machine according to claim 14 further including left sensor means and right sensor means associated with the hot mix delivery means for operating the corresponding left and right transfer conveyor independently of the opposite conveyor in accordance with the sensed presence or absence of hot mix material below the hot mix delivery means.

16. A repaving machine according to claim 14 or 15 including cross-transfer conveyor means for transferring hot mix between the left and right transfer conveyors.

17. A road resurfacing machine according to claim 3 further including means located behind the main scarifier means for moving the scarified material and for whipping the moving scarified material through the air past the spray means.

18. A method of repaving a surface of a macadam road, comprising the steps of heating the road surface; permitting the heat to soak into the road surface, preliminarily scarifying the heated road surface for loosening material from the road, further heating the road surface and the previously scarified material; scarifying the previously scarified material and road surface; causing scarified road material to travel up and over the upper end of a ramp means with whipping thereof for descent of the travelling, scarified material from the upper end of the ramp means through the air; spraying the descending scarified road material with an asphalt cutback liquid so as to replace previously lost asphalt constituents and with deposit of cutback liquid on the previously scarified pavement surface trailing the ramp means and in advance of the now spray coated descending scarified road material; adding loose, new hot mix material to the scarified, sprayed old material atop the road surface, so as to replace previously lost macadam solids; mixing the added new material and scarified, sprayed old material on the road surface; leveling and at least partly compacting the material on the road surface to form a first lift; spreading the added material above the first lift; and leveling and compacting the spread new material to form a second lift.

19. A method of repaving a macadam road according to claim 18, including the steps of receiving new hot mix material in a receiving hopper, conveying the received hot mix from the receiving hopper to a surge bin dispensing location by a conveying means, sensing the level of material at the material dispensing location, and halting operation of the conveying means when a sensed minimum level of hot mix at the material dispensing location is exceeded.

20. A method of repaving a macadam road according to claim 18 including the steps of sensing the demand for new hot mix at the left side of the repaving area, and delivering new hot mix to the left side of the repaving area in response to sensed demand therefore; and sensing the demand for new hot mix at the right side of the repaving area, and delivering new hot mix at the right side of the repaving area independently of sensed demand and delivery at the left side.

21. A method of repaving a macadam road according to claim 20 including the step of transferring hot mix between the left side and the right side of the paving area in response to sensed demand at the left and right sides.

22. A method of repaving a macadam road according to claim 20 including the steps of delivering demanded hot mix at the center of the repaving area, and spreading delivered mix toward the left, right, or both sides of the repaving area in response to a sensed absence of hot mix at the respective left, right or both sides of the repaving area.

* * * * *

UNITED STATES PATENT AND TRADEMARK OFFICE

CERTIFICATE OF CORRECTION

PATENT NO. : 4,534,674

DATED : August 13, 1985

INVENTOR(S) : Earl F. Cutler

It is certified that error appears in the above-identified patent and that said Letters Patent is hereby corrected as shown below:

Column 10, line 7, after "to the" please insert ---chassis for leveling and compacting the new hot mix material spread atop the first road lift so as to form a second road lift.---.

Column 10, line 16, please delete "primary".

Signed and Sealed this

*Third* Day of *June 1986*

[SEAL]

*Attest:*

DONALD J. QUIGG

*Attesting Officer*

*Commissioner of Patents and Trademarks*